US010056053B2

(12) United States Patent
Enami

(10) Patent No.: US 10,056,053 B2
(45) Date of Patent: Aug. 21, 2018

(54) ELECTROOPTICAL DEVICE, CONTROL METHOD OF ELECTROOPTICAL DEVICE AND ELECTRONIC DEVICE

(71) Applicant: SEIKO EPSON CORPORATION, Tokyo (JP)

(72) Inventor: Shinta Enami, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 15/467,043

(22) Filed: Mar. 23, 2017

(65) Prior Publication Data

US 2017/0287431 A1 Oct. 5, 2017

(30) Foreign Application Priority Data

Apr. 4, 2016 (JP) ..... 2016-074973

(51) Int. Cl.
*G09G 3/36* (2006.01)

(52) U.S. Cl.
CPC ..... *G09G 3/3696* (2013.01); *G09G 3/3677* (2013.01); *G09G 3/3688* (2013.01); *G09G 2310/027* (2013.01); *G09G 2310/08* (2013.01)

(58) Field of Classification Search
CPC ..... G09G 3/3696
USPC ..... 345/100, 210
See application file for complete search history.

(56) References Cited

U.S. PATENT DOCUMENTS

2003/0030602 A1* 2/2003 Kasai ..... G09G 3/325 345/76
2004/0246224 A1* 12/2004 Tsai ..... G09G 3/3611 345/100
2012/0056917 A1 3/2012 Ito
2013/0314397 A1* 11/2013 Tanaka ..... G02F 1/136213 345/215

FOREIGN PATENT DOCUMENTS

JP 2006-308712 A 11/2006
JP 2010-102217 A 5/2010
JP 2012-053407 A 3/2012

* cited by examiner

*Primary Examiner* — Roy P Rabindranath
(74) *Attorney, Agent, or Firm* — Oliff PLC

(57) ABSTRACT

An image signal with a magnitude in accordance with a tone to be displayed is supplied to pixels via data lines in a tone display period, and a precharge voltage including a low-potential second voltage and a high-potential second voltage is supplied to the data lines in a precharge period before the tone display period. Control is made such that a first pattern in which the low-potential second voltage and the high-potential second voltage are sequentially output in the precharge period in one horizontal scanning period and a second pattern in which only the high-potential second voltage is output in the precharge period in one horizontal scanning period are switched in accordance with a selected scanning line. Also, control is made such that a supply period of the high-potential second voltage in the second pattern is shorter than a supply period of the high-potential second voltage in the first pattern.

8 Claims, 8 Drawing Sheets

ELECTROOPTICAL DEVICE, CONTROL METHOD OF ELECTROOPTICAL DEVICE AND ELECTRONIC DEVICE

BACKGROUND

1. Technical Field

The present invention relates to technical fields of an electrooptical device such as a liquid crystal device, a control method of the electrooptical device, and an electronic device provided with the electrooptical device, such as a liquid crystal projector.

2. Related Art

Electrooptical devices that use liquid crystal elements to display images have widely been developed. According to such electrooptical devices, the transmittance of liquid crystals provided in the respective pixels is controlled to be a transmittance in accordance with designated tones of image signals by supplying the image signals for designating the display tones of the respective pixels to the respective pixels via data lines, and in doing so, the respective pixels are made to display the tones designated by the image signals.

Incidentally, in a case where image signals are not sufficiently supplied, for example, in a case where sufficient time for supplying image signals to the respective pixels cannot be secured, the respective pixels cannot accurately display the tones designated by the image signals, and display quality may deteriorate. In order to respond to the problem of the deterioration of display quality due to such insufficient writing of the image signals in the pixels, the following measure is employed in the related art. For example, a technology of facilitating the writing of image signals in the respective pixels by supplying a precharge signal with a potential that is close to a potential of the image signals to the respective pixels and the data lines prior to the supply of the image signals has been proposed in JP-A-2010-102217.

The precharge signal is an auxiliary signal for writing a voltage in all VID signal lines or data lines in advance prior to the writing of the image signals. Writing support and various correction failures are improved by writing a specific voltage in the period.

A drive method of supplying a precharge signal with a low potential before supplying a precharge signal with a high potential that is close to a potential of an image signal, which is called two-stage precharge drive, has also been proposed. According to the two-stage precharge drive, it is possible to achieve both an improvement in image quality and assistant of writing.

However, increases in the numbers of scanning lines and data lines, which accompany an increase in resolution of electrooptical devices require a shorter horizontal scanning period, and as a result, a horizontal fly-back period for supplying the precharge signals tends to be shorter. Thus, a drive method of supplying only the precharge signal with the high potential in the two-stage precharge during an arbitrary horizontal scanning period, which is called precharge thinning drive, has also been proposed in the related art. According to the precharge thinning drive, it is possible to shorten the supply period of the precharge signals and to shorten one horizontal scanning period by supplying only the precharge signal with the high potential.

However, the numbers of the scanning lines and the data lines have significantly increased with an increase in resolution in recent years, and a further shorter horizontal scanning period has been required even in a case where the two-stage precharge drive and the precharge thinning drive are combined. Therefore, an increase in the number of drivers as drive circuits for driving a liquid crystal panel, for example, has also been discussed. However, since the increase in the number of the drivers leads to an increase in cost, there is a need to shorten the horizontal scanning period while suppressing the increase in the number of the drivers (ICs).

SUMMARY

An advantage of some aspects of the invention is to provide an electrooptical device that can shorten the horizontal scanning period while suppressing an increase in the number of drivers, a control method of the electrooptical device, and an electronic device provided with the electrooptical device.

According to an aspect of the invention, there is provided an electrooptical device including: a plurality of scanning lines; a plurality of data lines; pixels that are provided so as to correspond to intersections between the plurality of scanning lines and the plurality of data lines; a scanning line drive unit that supplies a scanning signal to the scanning lines; a data line drive unit that supplies a first voltage with a magnitude in accordance with a tone to be displayed to the pixels via the data lines in a first period and supplies a second voltage including a low-potential second voltage and a high-potential second voltage to the data lines in a second period before the first period; and a control unit that controls the data line drive unit such that a first pattern in which the low-potential second voltage and the high-potential second voltage are sequentially output in the second period in one horizontal scanning period and a second pattern in which only the high-potential second voltage is output in the second period in one horizontal scanning period are switched in accordance with a selected scanning line, in which the control unit controls the data line drive unit such that a supply period of the high-potential second voltage in the second pattern is shorter than a supply period of the high-potential second voltage in the first pattern.

According to the aspect, the data line drive unit supplies the first voltage with the magnitude in accordance with the tone to be displayed to the pixels via the data lines in the first period, and supplies the second voltage including the low-potential second voltage and the high-potential second voltage to the data lines in the second period before the first period before the supply of the first voltage. In addition, both the improvement in image quality and the writing assistant are realized by sequentially supplying the low-potential second voltage and the high-potential second voltage as the second voltage. Furthermore, the data line drive unit selects the first pattern in which the low-potential second voltage and the high-potential second voltage are sequentially output in the second period in one horizontal scanning period when a specific scanning line is selected. The data line drive unit selects the second pattern in which only the high-potential second voltage is output in the second period in one horizontal scanning period when another scanning line is selected. As a result, it is possible to shorten the second period in the second pattern, in which only the high-potential second voltage is output in the second period, than that in the second period in the first pattern, and one horizontal scanning period is shortened. Furthermore, control is made such that the supply period of the high-potential second voltage in the second pattern is shorter than the supply period of the high-potential second voltage in the first pattern in a case where the second pattern is selected. As a result, it is possible to shorten the second period as compared with the second period in the first pattern, and one horizontal scanning period is further shortened.

In this case, the data line drive unit may include a voltage amplification unit and a D/A conversion unit. According to the aspect, the D/A conversion unit converts digital data indicating a tone into the analog first voltage, and the voltage amplification unit outputs the first voltage to the data lines in the first period. In the second period, the D/A conversion unit converts digital data that indicates the second voltage including the low-potential second voltage for improving image quality and the high-potential second voltage for assistant of writing into the analog second voltage, and the voltage amplification unit outputs the analog second voltage to the data lines. By supplying digital data corresponding to the low-potential second voltage and digital data corresponding to the high-potential second voltage as the digital data that indicates the second voltage at appropriate timing, it is possible to achieve the aforementioned switching between the first pattern and the second pattern.

In this case, the first period may include a tone display period, the second period may include a fly-back period, and the second voltage may include a precharge voltage. According to the aspect, the first voltage is written in the pixels via the data lines in the tone display period, and the precharge voltage is written in the data lines in the fly-back period. Since the precharge voltage is output from the external voltage output unit, the precharge voltage is written in the data lines at a high speed.

In this case, the electrooptical device may further include a data line selection unit that is provided between the data line drive unit and the data lines and selects the data lines in a time division manner. According to the aspect, since the data line selection unit selects the data lines in the time division manner, it is possible to shorten one horizontal scanning period as described above even in a case where the number of the pixels, that is, the numbers of the scanning lines and the data lines are large in correspondence with the increased resolution. As a result, it is possible to reliably write the first voltage and the second voltage.

According to another aspect of the invention, there is provided a control method of an electrooptical device that includes a plurality of scanning lines, a plurality of data lines, and pixels that are provided so as to correspond to the respective intersections between the plurality of scanning lines and the plurality of data lines, the method including: supplying a scanning signal to the scanning lines; supplying a first voltage with a magnitude in accordance with a tone to be displayed to the pixels via the data lines in a first period; supplying a second voltage including a low-potential second voltage and a high-potential second voltage to the data lines in a second period before the first period; and switching a first pattern in which the low-potential second voltage and the high-potential second voltage are sequentially output in the second period in one horizontal scanning period and a second pattern in which only the high-potential second voltage is output in the second period in one horizontal scanning period in accordance with a selected scanning line, in which a supply period of the high-potential second voltage in the second pattern is shorter than a supply period of the high-potential second voltage in the first pattern.

According to the aspect, the first voltage with the magnitude in accordance with the tone to be displayed is supplied to the pixels via the data lines in the first period, and the second voltage including the low-potential second voltage and the high-potential second voltage is supplied to the data lines in the second period before the first period before the supply of the first voltage. By sequentially supplying the low-potential second voltage and the high-potential second voltage as the second voltage, both the improvement in image quality and the writing assistant are realized. Furthermore, the first pattern in which the low-potential second voltage and the high-potential second voltage are sequentially output in the second period in one horizontal scanning period is selected when a specific scanning line is selected. A second pattern in which only the high-potential second voltage is output in the second period in one horizontal scanning period is selected when another scanning line is selected. As a result, it is possible to shorten the second period in the second pattern, in which only the high-potential second voltage is output in the second period, as compared with the second period in the first pattern, and one horizontal scanning period is shortened. Furthermore, control is made such that the supply period of the high-potential second voltage in the second pattern is shorter than the supply period of the high-potential second voltage in the first pattern in a case where the second pattern is selected. As a result, it is possible to shorten the second period as compared with the second period in the first pattern, and one horizontal scanning period is further shortened.

According to still another aspect of the invention, there is provided an electronic device including the aforementioned electrooptical device. According to such an electronic device, it is possible to shorten one horizontal scanning period in a display device such as a liquid crystal display, thereby to reliably write the first voltage and the second voltage, and to provide an electronic device with high image quality.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
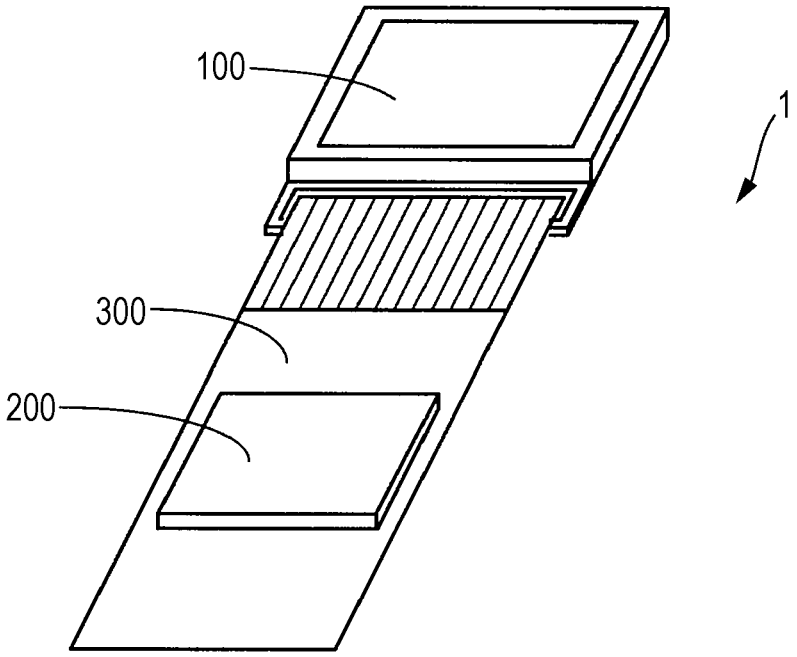
FIG. 1 is an explanatory diagram of an electrooptical device according to a first embodiment of the invention.

Description will be given of an embodiment of the invention with reference to FIGS. 1 to 6. FIG. 1 is a diagram illustrating a configuration of a signal transmission system for an electrooptical device 1. As illustrated in FIG. 1, the electrooptical device 1 includes an electrooptical panel 100, a drive integrated circuit 200, and a flexible circuit board 300, and the electrooptical panel 100 is connected to the flexible circuit board 300 on which the drive integrated circuit 200 is mounted. The electrooptical panel 100 is connected to a substrate of a host CPU device, which is not illustrated, via the flexible circuit board 300 and the drive integrated circuit 200. The drive integrated circuit 200 is a device that receives image signals and various control signals for drive and control from the host CPU device via the flexible circuit board 300 and drives the electrooptical panel 100 via the flexible circuit board 300.

Figure 2:
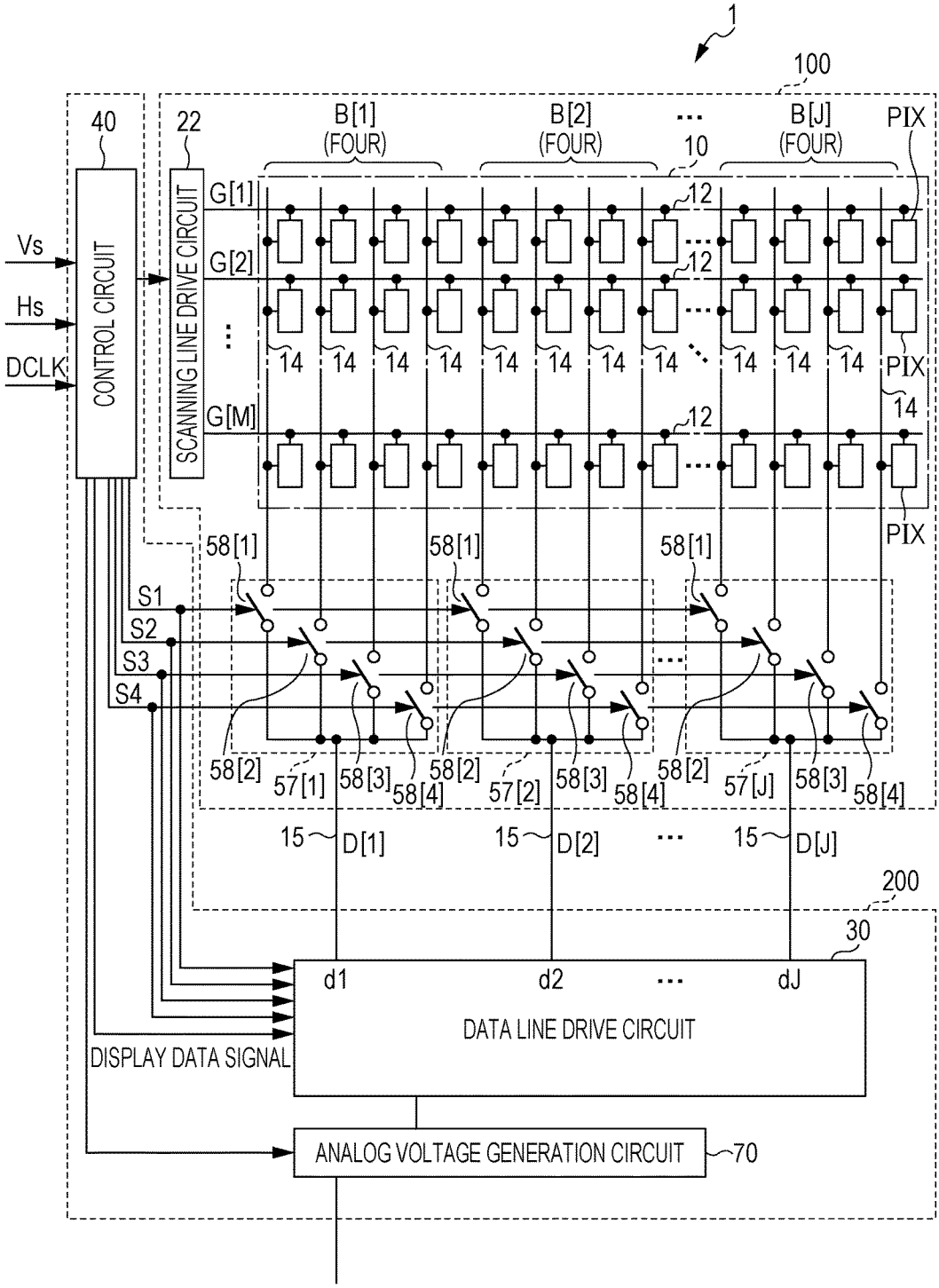
FIG. 2 is a block diagram illustrating a configuration of the electrooptical device according to the embodiment.

FIG. 2 is a block diagram illustrating configurations of the electrooptical panel 100 and the drive integrated circuit 200. As illustrated in FIG. 2, the electrooptical panel 100 includes a pixel unit 10, a scanning line drive circuit 22 as a scanning line drive unit, and J demultiplexers 57[1] to 57[J] (J is a natural number) as the data line selection unit. The drive integrated circuit 200 includes a data line drive circuit 30 as the data line drive unit, a control circuit 40 as the control unit, and an analog voltage generation circuit 70.

In the pixel unit 10, M scanning lines 12 and N data lines 14, which intersect each other, are formed (M and N are natural numbers). A plurality of pixel circuits (pixels) PIX are provided so as to correspond to intersections between the respective scanning lines 12 and the respective data lines 14 and are aligned in a matrix shape of M rows in the vertical direction and N columns in the horizontal direction.

Figure 3:
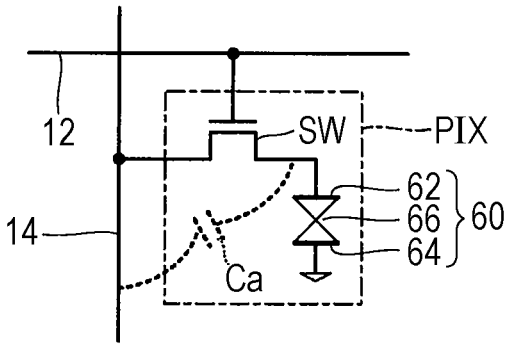
FIG. 3 is a circuit diagram illustrating a configuration of a pixel.

FIG. 3 is a circuit diagram of each pixel circuit PIX. As illustrated in FIG. 3, each pixel circuit PIX includes a liquid crystal element 60 and a switching element SW such as a TFT. The liquid crystal element 60 is an electrooptical element configured of a pixel electrode 62 and a common electrode 64, which face each other, and a liquid crystal 66 between both the electrodes. Transmittance (display tone) of the liquid crystal 66 varies in accordance with a voltage applied between the pixel electrode 62 and the common electrode 64. Another configuration can also be employed in which an auxiliary capacitance is connected in parallel with the liquid crystal element 60. The switching element SW is formed of an N-channel transistor with a gate connected to the scanning line 12, for example, is provided between the liquid crystal element 60 and the data line 14, and controls electrical connection (conduction/non-conduction) therebetween. The switching elements SW in the respective pixel circuits PIX on the m-th row (m=1 to M) are shifted to an ON state at the same time by setting the scanning signal G[m] to a selection potential.

When a scanning line 12 corresponding to a pixel circuit PIX is selected and a switching element SW in the pixel circuit PIX is controlled and brought into an ON state, a voltage in accordance with an image signal D to be supplied from a data line 14 to the pixel circuit PIX is applied to a liquid crystal element 60. As a result, a liquid crystal 66 in the pixel circuit PIX is set to have transmittance in accordance with the image signal D. Also, if a light source that is not shown in the drawing is brought into an ON (turned-on) state and light is emitted from the light source, the light penetrates the liquid crystal 66 in the liquid crystal element 60 provided in the pixel circuit PIX and advances toward the side of an observer. That is, the pixel corresponding to the pixel circuit PIX displays a tone in accordance with the image signal D in response to the application of the voltage in accordance with the image signal D to the liquid crystal element 60 and the light source being brought into the ON state.

If the switching element SW is brought into an OFF state after the voltage in accordance with the image signal D is applied to the liquid crystal element 60 in the pixel circuit PIX, the applied voltage corresponding to the image signal D is ideally held. Therefore, each pixel ideally displays the tone in accordance with the image signal D in a period after the switching element SW is brought into the ON state until the switching element SW is brought into the ON state next time.

As illustrated in FIG. 3, a capacitance Ca is parasitic between the data line 14 and the pixel electrode (or between the data line 14 and a wiring that electrically connects the pixel electrode 62 and the switching element SW). Therefore, variations in the potential of the data line 14 propagates to the pixel electrode 62 via the capacitance Ca and the application voltage of the liquid crystal element 60 varies while the switching element SW is in the OFF state, in some cases.

In addition, a common voltage LCCOM as a constant voltage is supplied to the common electrode 64 via a common line that is not illustrated in the drawing. As the common voltage LCCOM, a voltage of about −0.5 V is used on the assumption that the center voltage of the image signal D is 0 V. This is based on properties of the switching element SW and the like.

In order to prevent so-called ghosting, polarity reversion drive of reversing polarity of the voltage to be applied to the liquid crystal element 60 in a predetermined period is employed in this embodiment. In this example, the level of the image signal D supplied to the pixel circuits PIX via the data lines 14 is reversed every unit period with respect to the center voltage of the image signal D. The unit period is a period corresponding to one unit of the operation of driving the pixel circuits PIX. In this example, the unit period is a vertical scanning period V. However, the unit period can be arbitrarily set and may be a multiple natural number of the vertical scanning period V, for example. In this embodiment, a case where the image signal D has a higher voltage than the center voltage of the image signal D will be regarded as positive polarity, and a case where the image signal D has a lower voltage than the center voltage of the image signal D will be regarded as negative polarity.

Description will be returned to FIG. 2. The external host CPU device that is not illustrated inputs external signals such as a vertical synchronization signal Vs for defining a vertical scanning period V, a horizontal synchronization signal Hs for defining a horizontal scanning period H, and a dot clock signal DCLK to the control circuit 40. The control circuit 40 controls and synchronizes the scanning line drive circuit 22 and the data line drive circuit 30 based on these signals. Under such synchronization and control, the scanning line drive circuit 22 and the data line drive circuit 30 cooperate to perform display control of the pixel unit 10.

Generally, display data configuring one display screen is processed in unit of frames, and a processing period is one frame period (1F). The frame period F corresponds to the vertical scanning period V in a case where one display screen is formed of vertical scanning performed once.

The scanning line drive circuit 22 outputs scanning signals G[1] to G[M] to each of M scanning lines 12. The scanning line drive circuit 22 sequentially brings the scanning signals G[1] to G[M] to the respective scanning lines 12 into an active level every horizontal scanning period (1H) during the vertical scanning period V in accordance with an output of the horizontal synchronization signal Hs from the control circuit 40.

Here, the respective switching elements SW in N pixel circuits PIX on the m-th row are in the ON state during a period in which the scanning signal G[m] corresponding to the m-th row is in the active level and the scanning lines corresponding to the row are selected. As a result, the N data lines 14 are electrically connected to the respective pixel electrodes 62 in the N pixel circuits PIX on the m-th row via these respective switching elements SW.

According to the embodiment, the N data lines 14 in the pixel unit 10 are divided into J wiring blocks B[1] to B[J] in units of four mutually adjacent data lines 14 (J=N/4; N is a multiple of 4 in this example). In other words, the data lines 14 are grouped into each wiring block B. The demultiplexers 57[1] to 57[J] respectively correspond to the J wiring blocks B[1] to B[J].

Each demultiplexer 57[*j*] (j=1 to J) as the data line selection unit is configured of four switches 58[1] to 58[4]. In each demultiplexer 57[*j*], one contact point of each of the four switches 58[1] to 58[4] is commonly connected. In addition, the commonly connected point of the one contact point of each of the four switches 58[1] to 58[4] in the demultiplexer 57[*j*] is connected to each of J VID signal lines 15. The J VID signal lines 15 are connected to the data line drive circuit 30 of the drive integrated circuit 200 via the flexible circuit board 300.

In each demultiplexer 57[*j*], the other contact point of each of the four switches 58[1] to 58[4] is connected to each of the four data lines 14 configuring the wiring block B[*j*] corresponding to the demultiplexer 57[*j*].

The ON/OFF states of the four switches 58[1] to 58[4] in each demultiplexer 57[*j*] are switched by four selection signals S1 to S4. The four selection signals S1 to S4 are supplied from the control circuit 40 of the drive integrated circuit 200 via the flexible circuit board 300. Here, only J switches 58[1] that respectively belong to the demultiplexers 57[*j*] are turned on in a case where one selection signal S1 is in an active level while the other three selection signals S2 to S4 are in a non-active level, for example. Therefore, the respective demultiplexers 57[*j*] output the image signals D[1] to D[J] on the J VID signal lines 15 to the first data lines 14 in the respective wiring blocks B[1] to B[J]. Thereafter, the image signals D[1] to D[J] on the J VID signal lines 15 are output to the second, third, and fourth data lines 14 in the respective wiring blocks B[1] to B[J] in the same manner.

The control circuit 40 includes a frame memory, at least has a memory space of M×N bits corresponding to resolution of the pixel unit 10, and stores and holds, in units of frames, display data input from the external host CPU device that is not illustrated. Here, the display data that defines the tone of the pixel unit 10 is 64-tone data configured of 6 bits in one example. The display data read from the frame memory is transferred as a display data signal in series to the data line drive circuit 30 via a 6-bit bus.

The control circuit 40 may be configured to include a line memory for at least one line. In such a case, the display data for one line is accumulated in the line memory, and the display data is transferred to the respective pixels.

The data line drive circuit 30 as the data line drive unit cooperates with the scanning line drive circuit 22 and outputs data to be supplied to each pixel row as a data writing target to the data lines 14. The data line drive circuit 30 generates latch signals based on the selection signals S1 to S4 output from the control circuit 40 and sequentially latches a precharge signal and N 6-bit display data signals supplied as serial data. According to the embodiment, the display data signals are grouped into chronological data for every four pixels. In addition, the data line drive circuit 30 is provided with a Digital to Analog (D/A) conversion circuit as the D/A conversion unit and a voltage amplification unit. The D/A conversion circuit performs D/A conversion based on grouped digital data and an analog voltage generated by the analog voltage generation circuit 70 and generates a voltage as analog data by further causing the voltage amplification unit to perform amplification. In doing so, the display data signals that are arranged in a time series manner in units of four pixels are also converted into a predetermined data voltage (first voltage). Also, the precharge signal is converted into a predetermined precharge voltage (second voltage), and a set of the precharge voltage and the data voltage corresponding to four pixels is supplied to each VID signal line 15 in this order. As described above, the data line drive circuit 30 also functions as an output unit of the precharge voltage as the second voltage.

Conduction (ON/OFF) of the respective switches 58[1] to 58[4] in the respective demultiplexers 57[*j*] are controlled by the selection signals S1 to S4 output from the control circuit 40, and the respective switches 58[1] to 58[4] are turned on at predetermined timing. In a precharge signal application period, the conduction is controlled by the selection signals S1 to S4 output from the control circuit 40, and the respective switches 58[1] to 58[4] in the demultiplexers 57[*j*] are turned on at the same time.

In this way, the precharge voltage and the data voltage for four pixels supplied to the respective VID signal lines 15 are output to the data lines 14 in a chronological manner by the switches 58[1] to 58[4] in one horizontal scanning period (1H).

Since polarity reversion drive is employed, and also, two-stage precharge drive is employed in the embodiment, four precharge voltages are used. Precharge means writing of a predetermined voltage in all the VID signal lines 15 and the data lines 14 in advance before writing the image signals (data voltage) in the data lines 14. In addition, the two-stage precharge drive means precharge drive that includes precharge in the first stage and precharge in the second stage and is performed in a stepwise manner. The first precharge is precharge of setting a level of the precharge voltage to a voltage level for black display (low-potential second voltage), for example, in order to prevent vertical crosstalk. In the second precharge, a voltage level for an intermediate tone (high-potential second voltage), for example, is set in order to support writing by the data line drive circuit 30.

Furthermore, precharge thinning drive is employed in the embodiment. The precharge thinning drive means precharge drive in which only precharge by the high-potential second voltage is performed in an arbitrary horizontal scanning period instead of performing the two-stage precharge drive in all the horizontal scanning periods. By omitting the precharge by the low-potential second voltage, it is possible to shorten the length of one horizontal scanning period.

According to the embodiment, two patterns, namely a first pattern in which the two-stage precharge drive is performed and a second pattern in which the precharge thinning drive is performed are switched depending on a horizontal scanning period. Hereinafter, the precharge drive scheme in the embodiment will be described in detail with reference to FIGS. 4 and 5.

Figure 4:
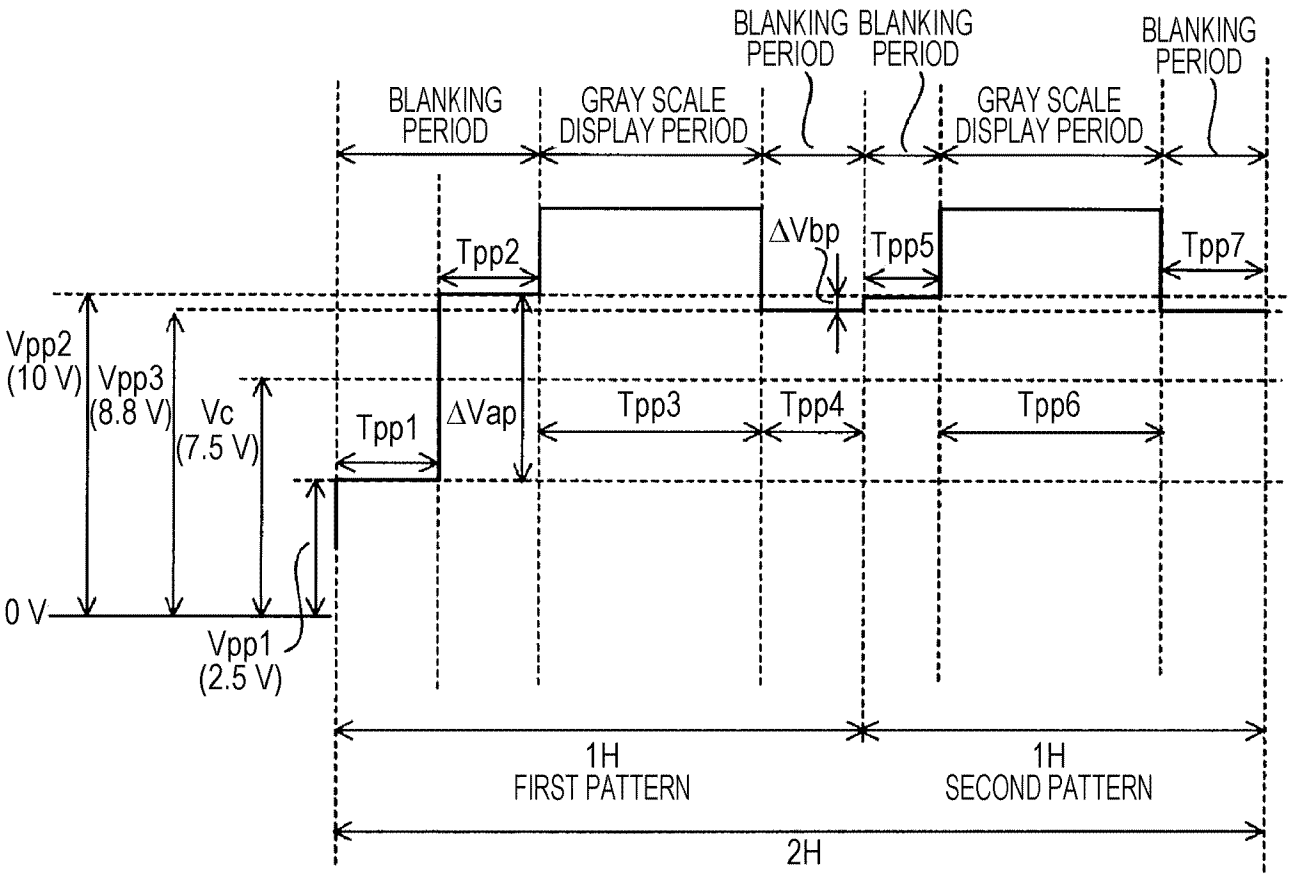
FIG. 4 is a diagram schematically illustrating an output waveform of a data line drive circuit in positive polarity drive.
Figure 5:
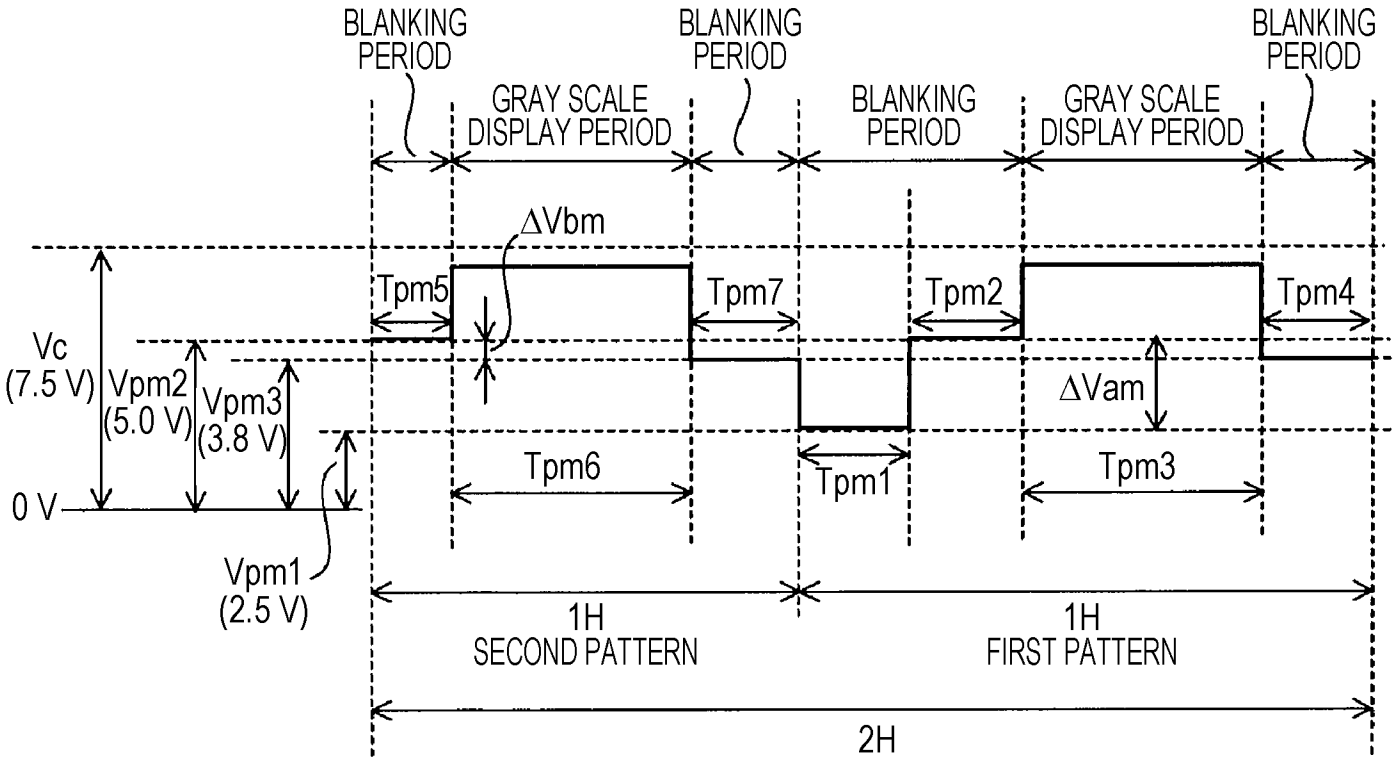
FIG. 5 is a diagram schematically illustrating an output waveform of the data line drive circuit in negative polarity drive.

FIG. 4 is a diagram illustrating an outline of an output waveform of the data line drive circuit 30, which is output to the VID signal line 15 during positive polarity drive. FIG. 5 is a diagram illustrating an outline of an output waveform of the data line drive circuit 30, which is output to the VID signal line 15 during negative polarity drive. In FIGS. 4 and 5, the image signal output in the tone display period is illustrated to have a constant voltage for convenience.

As illustrated in FIG. 4 one horizontal scanning period (1H) is configured by a tone display period Tpp3 as a first period and a fly-back period as a second period in the first pattern in which the two-stage precharge drive is performed during the positive polarity drive. Furthermore, the fly-back period is configured of a first-stage precharge period Tpp1, a second-stage precharge period Tpp2, and a post charge period Tpp4 in the first pattern. The first-stage precharge is performed for the purpose of improving image quality, and the low-potential second voltage is supplied. The second precharge is performed for the purpose of assisting writing of the image signal, and the high-potential second voltage is supplied. The post charge is performed for the purpose of improving tone dependency during the precharge. Since the voltage of the image signal output in the tone display period Tpp3 is a voltage that varies in accordance with the tone, a voltage difference between the voltage of the image signal and the voltage of the precharge varies if the precharge is performed immediately after the image signal. As a result, it is also considered that the writing of the precharge voltage in the data lines 14 cannot be completed in a predetermined period depending on the tone before the precharge. Thus, a constant post precharge voltage is written in the data lines 14 after the completion of the tone display period Tpp3, thereby enabling reliable writing of the precharge voltage in the data lines 14 without depending on the tone before the precharge.

As illustrated in FIG. 4, one horizontal scanning period (1H) is configured by a tone display period Tpp6 as the first period and a fly-back period as the second period even in the second pattern in which the precharge thinning drive is performed during the positive polarity drive. The fly-back period is configured of a second-stage precharge period Tpp5 and a post charge period Tpp7 in the second pattern. As described above, the first-stage precharge of supplying the low-potential second voltage is omitted, and only the second-stage precharge of supplying the high-potential second voltage is performed in the second pattern.

As illustrated in FIG. 5, one horizontal scanning period (1H) is configured by a tone display period Tpm3 as the first period and a fly-back period as the second period in the first pattern in which the two-stage precharge drive is performed during the negative polarity drive. Furthermore, the fly-back period is configured of a first-stage precharge period Tpm1, a second-stage precharge period Tpm2, and a post charge period Tpm4 in the first pattern.

As illustrated in FIG. 5, one horizontal scanning period (1H) is configured of a tone display period Tpm6 as the first period and a fly-back period as the second period even in the second pattern in which the precharge thinning drive is performed during the negative polarity drive. The fly-back period is configured of a second-stage precharge period Tpm5 and a post charge period Tpm7 in the second pattern. As described above, the first-stage precharge is omitted, and only the second-stage precharge of supplying the high-potential second voltage is performed in the second pattern.

According to the embodiment, a first-stage precharge voltage Vpp1 in the positive polarity drive is set to 2.5 V, and a video center voltage Vc is set to 7.5 V in one example. In addition, a second-stage precharge voltage Vpp2 in the positive polarity drive is set to 10.0 V, and a post precharge voltage Vpp3 in the positive polarity drive is set to 8.8 V. In addition, a first-stage precharge voltage Vpm1 with the negative polarity is set to 2.5 V, a second-stage precharge voltage Vpm2 with the negative polarity is set to 5.0 V, and a post precharge voltage Vpm3 with the negative polarity is set to 3.8 V. The respective voltage values are not limited to these voltage values and can appropriately be changed.

Here, a voltage difference between the second-stage precharge voltage and an immediately previous voltage will be described. As illustrated in FIG. 4, the voltage immediately before the second-stage precharge voltage Vpp2 is the first-stage precharge voltage Vpp1 in the first pattern with the positive polarity, and the voltage difference ΔVap is as follows.

$$\Delta Vap = Vpp2 - Vpp1 = 10.0 - 2.5 = 7.5 \text{ [V]}$$

In the second pattern of the positive polarity, the voltage immediately before the second-stage precharge voltage Vpp2 is the post precharge voltage Vpp3, and the voltage difference ΔVbp is as follows.

$$\Delta Vbp = Vpp2 - Vpp3 = 10.0 - 8.8 = 1.2 \text{ [V]}$$

As illustrated in FIG. 5, the voltage immediately before the second-stage precharge voltage Vpm2 is the first-stage precharge voltage Vpm1 in the first pattern with the negative polarity, and the voltage difference ΔVam is as follows.

$$\Delta Vam = Vpm2 - Vpm1 = 5.0 - 2.5 = 2.5 \text{ [V]}$$

In the second pattern of the negative polarity, the voltage immediately before the second-stage precharge voltage Vpm2 is the post precharge voltage Vpm3, and the voltage difference ΔVbm is as follows.

$$\Delta Vbm = Vpm2 - Vpm3 = 5.0 - 3.8 = 1.2 \text{ [V]}$$

If only a capacitive load and a resistive load of the data lines 14 are taken into consideration, a ratio between time required for writing the second-stage precharge voltage Vpp2 in the first pattern and time required for writing the second-stage precharge voltage Vpp2 in the second pattern is as follows. The ratio is a ratio between the voltage difference ΔVap and the voltage difference ΔVbp and is represented as follows.

$$\text{Voltage difference } \Delta Vbp/\text{Voltage difference } \Delta Vap = 1.2/7.5 \approx 1/6.$$

That is, the writing of the second-stage precharge voltage Vpp2 in the second pattern with the positive polarity can be completed in time that is ⅙ times as long as the time required for writing the second-stage precharge voltage Vpp2 in the first pattern with the positive polarity.

Similarly, a ratio between time required for writing the second-stage precharge voltage Vpm2 in the first pattern with the negative polarity and time required for writing the second-stage precharge voltage Vpm2 in the second pattern with the negative polarity is a ratio between the voltage difference ΔVam and the voltage difference ΔVbm and is represented as follows.

$$\text{Voltage difference } \Delta Vbm/\text{Voltage difference } \Delta Vam = 1.2/2.5 \approx 1/2$$

That is, the writing of the second-stage precharge voltage Vpm2 in the second pattern with the negative polarity can be completed in time that is ½ times as long as time required for writing the second-stage precharge voltage Vpm2 in the first pattern with the negative polarity.

Thus, control is made such that the second-stage precharge period Tpp5 in the second pattern with the positive polarity is shorter than the second-stage precharge period Tpp2 in the first pattern with the positive polarity according to the embodiment. Similarly, control is made such that the second-stage precharge period Tpm5 in the second pattern with the negative polarity is shorter than the second-stage precharge period Tpm2 in the first pattern with the negative polarity. In one example, the second-stage precharge periods Tpp5 and Tpm5 in the second pattern are set to range from 80 to 90 ns while the second-stage precharge periods Tpp2 and Tpm2 in the first pattern are set to range from 250 to 270 ns.

By shortening the second-stage precharge periods Tpp5 and Tpm5 in the second pattern as described above, it is possible to shorten one horizontal scanning period (1H) when the second pattern is used as compared with one horizontal scanning period (1H) when the first pattern is used. Therefore, it is possible to assign the shortened time of the second-stage precharge periods in the second pattern to another period in the two horizontal scanning periods (2H) corresponding to two cycles of the horizontal synchronization signal input from the external host CPU device.

According to the embodiment, the shortened time is assigned to the tone display periods Tpp3, Tpp6, Tpm3, and Tpm6 and the post precharge periods Tpp4, Tpp7, Tpm4, and Tpm7. Also, the shortened time is assigned to the precharge periods Tpp1, Tpp2, Tpm1, and Tpm2 in the first pattern. As a result, it is possible to secure periods necessary as the tone display periods, the post precharge periods, and the precharge periods. According to the embodiment, equal periods are secured for the tone display period Tpp3 in the first pattern and the tone display period Tpp6 in the second pattern of the positive polarity. Also, equal periods are secured for the post precharge period Tpp4 in the first pattern and the post precharge period Tpp7 in the second pattern of the positive polarity. Similarly, equal periods are secured for the tone display period Tpm3 in the first pattern and the tone display period Tpm6 in the second pattern of the negative polarity. Also, equal periods are secured for the post precharge period Tpm4 in the first pattern and the post precharge period Tpm7 in the second pattern of the negative polarity. Furthermore, necessary periods as the precharge periods Tpp1 and Tpp2 in the first pattern of the positive polarity are secured. Also, necessary periods as the precharge periods Tpm1 and Tpm2 in the first pattern of the negative polarity are secured.

As a result, it is possible to increase the resolution of the electrooptical device 1 and to reliably write the precharge voltage and the image signal in the data lines 14 even in a case where the numbers of the data lines 14 and the scanning lines 12 increase.

The control of the precharge periods is realized by the control circuit 40 outputting the control signal and the precharge data to the data line drive circuit 30. The data line drive circuit 30 includes a latch circuit, and it is possible to control the precharge periods to desired periods by outputting precharge data from the control circuit 40 to the data line drive circuit 30 at predetermined timing and outputting a latch signal.

Figure 6:
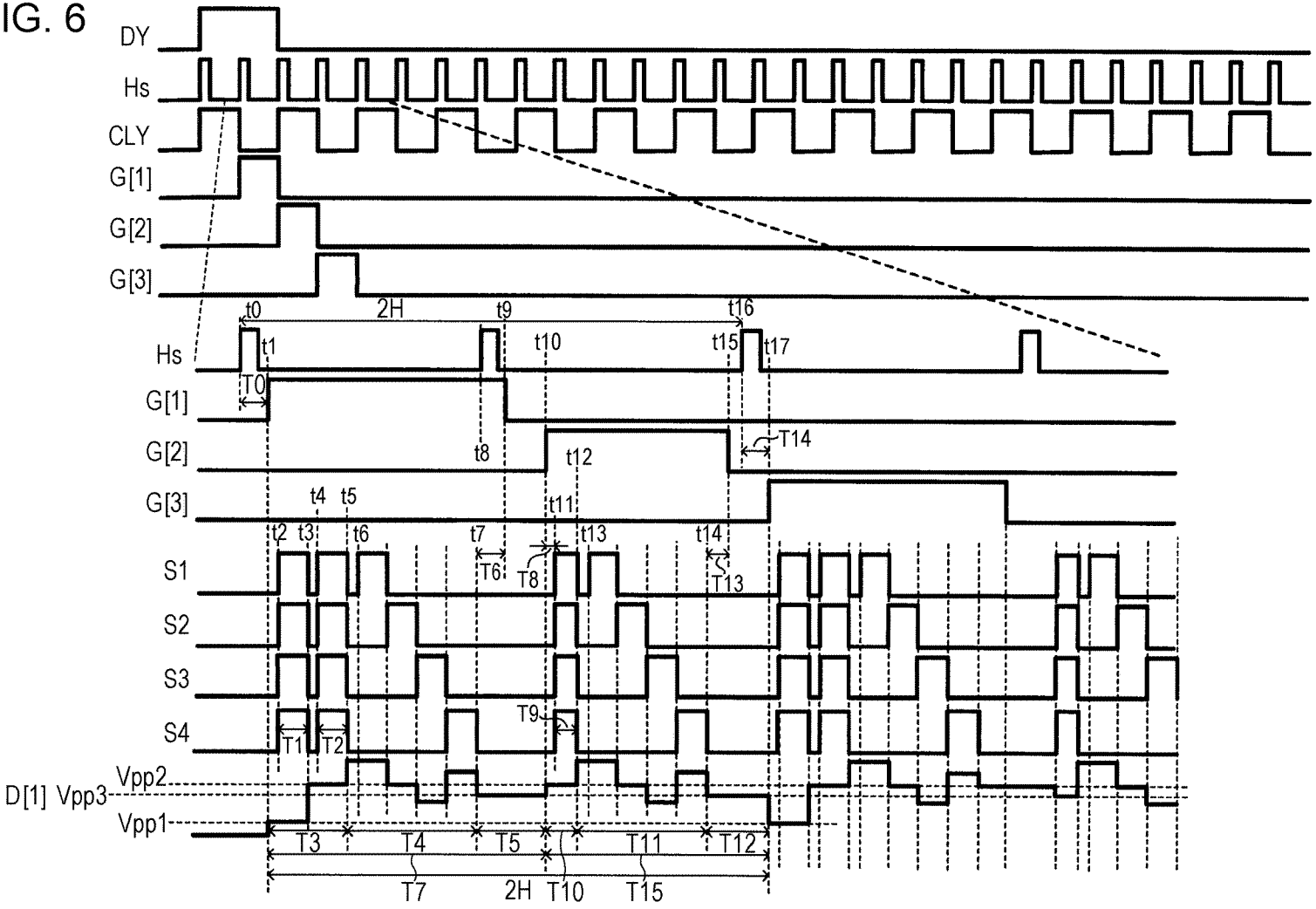
FIG. 6 is a timing chart of the drive integrated circuit.

Next, one example of the control according to the embodiment will be described with reference to FIG. 6. FIG. 6 is a timing chart of the drive integrated circuit 200. In the example illustrated in FIG. 6, the first pattern of performing the two-stage precharge drive is selected in the horizontal scanning period corresponding to the scanning lines 12 on the first row and the third row. Also, the second pattern of performing the precharge thinning drive is selected in the horizontal scanning period corresponding to the scanning line 12 on the second row.

If the horizontal synchronization signal Hs is input from the external host CPU device to the control circuit 40, the control circuit 40 drives the scanning line drive circuit 22 in synchronization with the horizontal synchronization signal Hs. The scanning line drive circuit 22 generates scanning signals G[1], G[2], . . . , G[M] by sequentially shifting a signal corresponding to a Y transfer start pulse DY of a one frame (1F) cycle in accordance with a Y clock signal CLY. The scanning signals G[1], G[2], . . . , G[M] are sequentially set in an active state in each horizontal scanning period H.

The data line drive circuit 30 generates sampling pulses SP1, SP2, . . . , SPz (not illustrated) based on an X transfer start pulse DX (not illustrated) of a horizontal scanning cycle and an X clock signal CLX (not illustrated).

The data line drive circuit 30 outputs the precharge voltage based on the precharge signal. The data line drive circuit 30 samples image signals VID1 to VIDJ (not illustrated) by using sampling pulses SP1, SP2, . . . , SPz (not illustrated) and generates image signals D[1] to D[J]. The image signals D[1] to D[J] are set to a data voltage.

The control circuit 40 outputs the selection signals S1 to S4 to the data line drive circuit 30 and four switches 58[1] to 58[4] of each demultiplexer 57[*j*] in synchronization with the horizontal synchronization signal Hs. The data line drive circuit 30 outputs the precharge voltage and the image signals D[1] to D[J] from output terminals d1 to dJ to the VID signal lines 15. The four switches 58[1] to 58[4] of each demultiplexer 57[*j*] are turned on and off based on the selection signals S1 to S4.

According to the embodiment, the control circuit 40 performs drive control in two horizontal scanning periods 2H, which are a set of two horizontal scanning periods H, based on the specific horizontal synchronization signal Hs and shortens each horizontal scanning period H.

First, the control circuit 40 performs the drive control in the first pattern including the two-stage precharge drive. The control circuit 40 activates the scanning signal G[1] at timing t1 after timing to, at which the horizontal synchronization signal Hs is activated, by a period T0. Also, the control circuit 40 outputs the first-stage precharge signal corresponding to the low-potential second voltage of the positive polarity to the data line drive circuit 30 at the timing t1. The data line drive circuit 30 samples the first-stage precharge signal by using the sampling pulses SP1, SP2, . . . , SPz (not illustrated) and generates the first-stage precharge voltage Vpp1 with the positive polarity. The data line drive circuit 30 outputs the first-stage precharge voltage Vpp1 with the positive polarity from the output terminals d1 to dJ to the VID signal lines 15.

The control circuit 40 outputs the selection signals S1 to S4 for turning on the switches 58[1] to 58[4] at the same time at timing t2 in synchronization with the horizontal synchronization signal Hs. As a result, the first-stage precharge voltage Vpp1 with the positive polarity is written in all the VID signal lines 15 and the data lines 14 in the period T1.

The control circuit 40 outputs the selection signals S1 to S4 for turning off the switches 58[1] to 58[4] at the same time at timing t3 after the timing t2 by a period T1. The period T1 is a supply period of the first-stage precharge voltage Vpp1 in the first pattern.

The control circuit 40 outputs the second-stage precharge signal corresponding to the high-potential second voltage with the positive polarity to the data line drive circuit 30 at the timing t3.

The data line drive circuit 30 samples the second-stage precharge signal by using the sampling pulses SP1, SP2, . . . , SPz (not illustrated) and generates the second-stage precharge voltage Vpp2 with the positive polarity. The data line drive circuit 30 outputs the second-stage precharge voltage Vpp2 with the positive polarity from the output terminals d1 to dJ to the VID signal lines 15.

The control circuit 40 outputs the selection signals S1 to S4 for turning on the switches 58[1] to 58[4] at the same time at timing t4 in synchronization with the horizontal synchronization signal Hs. As a result, the second-stage precharge voltage Vpp2 with the positive polarity is written in all the VID signal lines 15 and the data lines 14.

The control circuit 40 outputs the selection signals S1 to S4 for turning off the switches 58[1] to 58[4] at the same time at timing t5 after the timing t4 by a period T2. The period T2 is a supply period of the second-stage precharge voltage Vpp1 in the first pattern. In addition, the period T3 from the timing t1 to the timing t5 is the entire precharge period in the first pattern.

The control circuit 40 outputs display data signals corresponding to the image signals VID1 to VIDJ (not illustrated) to the data line drive circuit 30 at the timing t5.

The data line drive circuit 30 samples the image signals VID1 to VIDJ (not illustrated) by using the sampling pulses SP1, SP2, . . . , SPz (not illustrated) and generates the image signals D[1] to D[J]. The image signals D[1] to D[J] are set to a data voltage. The data line drive circuit 30 outputs the image signals D[1] to D[J] from the output terminals d1 to dJ to the VID signal lines 15.

The control circuit 40 outputs the selection signals S1 to S4 to the data line drive circuit 30 and the four switches 58[1] to 58[4] of each demultiplexer 57[*j*] in synchronization with the horizontal synchronization signal Hs at and after timing t6. The four switches 58[1] to 58[4] of each demultiplexer 57[*j*] are turned on and off based on the selection signals S1 to S4, and the precharge voltage and the image signals D[1] to D[J] are respectively output to the data lines 14.

The period T4 from the timing t5 at which the image signals D[1] to D[J] are output to the VID signal lines 15 to timing t7 at which the selection signal S4 is turned off is the tone display period in the first pattern.

The control circuit 40 outputs a post precharge signal corresponding to the post precharge voltage with the positive polarity to the data line drive circuit 30 at the timing t7 at which the selection signal S4 is turned off.

The period T5 from the timing t7 at which the selection signal S4 is turned off to timing t10 at which the scanning signal G[2] is activated is the post precharge period in the first pattern. In the post precharge period, the selection signals S1 to S4 are maintained in the off state. However, the post precharge voltage Vpp3 can be maintained as a constant voltage for wiring (corresponding to the VID signal lines 15) before the switches 58[1] to 58[4] regardless of the displayed tone. As a result, it is possible to shorten the time required for writing the first-stage precharge voltage Vpp1 in the next horizontal scanning period regardless of the displayed tone.

The control circuit 40 inactivates the scanning signal G[1] at timing t9 after the timing t7 by the period T6. The control circuit 40 activates the scanning signal G[2] at the timing t10 at which the period T5 as the post precharge period ends.

The timing at which the control circuit 40 activates the scanning signal G[1] is synchronized with the horizontal synchronization signal Hs that starts at the timing t0. However, the timing at which the control circuit 40 activates the scanning signal G[2] is not synchronized with the horizontal synchronization signal Hs that starts at the timing t8. This is because control is made in the two horizontal scanning periods (2H) from the timing t0 as one set in the embodiment.

The period T7 from the timing t1 at which the scanning signal G[1] to the timing t10 at which the scanning signal G[2] is activated is one horizontal scanning period (1H) corresponding to the first scanning line 12. In the embodiment, one horizontal scanning period corresponding to the first scanning line 12 is for the first pattern of performing the two-stage precharge drive.

Next, the control circuit 40 performs drive control in the second pattern including the precharge thinning drive. The control circuit 40 outputs the second-stage precharge signal corresponding to the high-potential second voltage with the positive polarity to the data line drive circuit 30 at the timing t10 at which the scanning signal G[2] is activated. The data line drive circuit 30 samples the second-stage precharge signal by using the sampling pulses SP1, SP2, . . . , SPz (not illustrated) and generates the second-stage precharge voltage Vpp2 with the positive polarity. The data line drive circuit 30 outputs the second-stage precharge voltage Vpp2 with the positive polarity from the output terminals d1 to dJ to the VID signal lines 15.

The control circuit 40 outputs the selection signals S1 to S4 for turning on the switches 58[1] to 58[4] at timing t11 after the timing t10, at which the scanning signal G[2] is activated, by the period T8. As a result, the second-stage precharge voltage Vpp2 with the positive polarity is written in all the VID signal lines 15 and the data lines 14.

The control circuit 40 outputs the selection signals S1 to S4 for turning off the switches 58[1] to 58[4] at the same time at timing t12 after the timing t11 by the period T9. The period T9 is a supply period of the second-stage precharge voltage Vpp2 in the second pattern. The period T9 is a period shorter than then period T2 as the supply period of the second-stage precharge voltage Vpp2 in the first pattern. In addition, the period T10 from the timing T10 to the timing t12 is the entire precharge period in the second pattern.

The control circuit 40 outputs the display data signals corresponding to the image signals VID1 to VIDJ (not illustrated) to the data line drive circuit 30 at the timing t12.

The data line drive circuit 30 samples the image signals VID1 to VIDJ (not illustrated) by using the sampling pulses SP1, SP2, . . . , SPz (not illustrated) and generates the image signals D[1] to D[J]. The image signals D[1] to D[J] are set to the data voltage. The data line drive circuit 30 outputs the image signals D[1] to D[J] from the output terminals d1 to dj to the VID signal lines 15.

The control circuit 40 outputs the selection signals S1 to S4 to the data line drive circuit 30 and the four switches 58[1] to 58[4] of each demultiplexer 57[*j*] in synchronization with the horizontal synchronization signal Hs at and after timing t13. The four switches 58[1] to 58[4] of each demultiplexer 57[*j*] are turned on and off based on the selection signals S1 to S4, and the precharge voltage and the image signals D[1] to D[J] are respectively output to the data lines 14.

The period T11 from the timing t13 at which the selection signal S1 is turned on to timing t14 at which the selection signal S4 is turned off is the tone display period in the second pattern.

The control circuit 40 outputs the post precharge signal corresponding to the post precharge voltage with the positive polarity to the data line drive circuit 30 at the timing t14 at which the selection signal S4 is turned off.

The data line drive circuit 30 samples the post precharge signal by using the sampling pulses SP1, SP2, . . . , SPz (not illustrated) and generates the post precharge voltage Vpp3 with the positive polarity. The data line drive circuit 30 outputs the post precharge voltage Vpp3 with the positive polarity from the output terminals d1 to dj to the VID signal lines 15.

The period T12 from the timing t14 at which the selection signal S4 is turned off to timing t17 at which the scanning signal G[3] is activated is the post precharge period in the second pattern.

The control circuit 40 inactivates the scanning signal G[2] at timing t15 after the timing t14 by the period T13. In addition, the control circuit 40 activates the scanning signal G[3] at the timing t17 after timing t16, at which the horizontal synchronization signal Hs starts, by the period T14. The period T15 from the timing t10 at which the scanning signal G[2] to the timing t17 at which the scanning signal G[3] is activated is the horizontal scanning period H corresponding to the second scanning line 12. In the embodiment, the horizontal scanning period H corresponding to the second scanning line 12 is for the second pattern of performing the precharge thinning drive.

As described above, the drive control is performed in the two horizontal scanning periods 2H as one set of two horizontal scanning periods H, namely the horizontal scanning period H in the first pattern and the horizontal scanning period H in the second pattern. At and after the timing t17, the drive control is similarly performed in the two horizontal scanning periods 2H as one set of the two horizontal scanning periods H, namely the horizontal scanning period H in the first pattern and the horizontal scanning period H in the second pattern.

Although not illustrated in the drawing, the drive control is similarly made in the two horizontal scanning periods 2H as one set of two horizontal scanning periods H, namely the horizontal scanning period H in the first pattern and the horizontal scanning period H in the second pattern even in the negative polarity period of the polarity reversion drive.

As is obvious from FIG. 6, the period T7 as the supply period of the second-stage precharge voltage Vpp2 in the second pattern is set to be shorter than the period T2 as the supply period of the second-stage precharge voltage Vpp2 in the first pattern. Therefore, the period T13 as the horizontal scanning period H in the second pattern is shorter than the horizontal scanning period H as a reference from the timing t8 at which the horizontal synchronization signal Hs starts to the timing t16 at which the next horizontal synchronization signal Hs starts. However, the period T4 as the tone display period in the first pattern is equal to the period T11 in the tone display period in the second pattern. Also, the period T5 as the post precharge period in the first pattern is equal to the period T12 in the post precharge period in the second pattern.

As described above, the supply period of the second-stage precharge voltage Vpp2 in the precharge thinning drive is set to be shorter than the supply period of the second-stage precharge voltage Vpp2 in the two-stage precharge drive in the embodiment. As a result, it is possible to shorten the horizontal scanning period H in the second pattern. Also, it is possible to secure the necessary tone display period and the post precharge period in both the first pattern and the second pattern in a case where the two horizontal scanning period 2H is considered as one set. In addition, it is possible to secure the necessary entire precharge period by the two-stage precharge in the first pattern. According to the invention, it is possible to substantially shorten the horizontal scanning period without increasing the number of the drive integrated circuits (Drivers).

Modification Examples

The invention is not limited to the aforementioned embodiments, and for example, various modifications descried below can be made. It is a matter of course that the respective embodiments and the respective modification examples may be appropriately combined.

(1) In the aforementioned embodiment, the control circuit 40 performs control such that one horizontal scanning period in the second pattern is shortened based on the specific horizontal synchronization signal Hs. However, the invention is not limited to such a configuration, and control may be made such that the horizontal synchronization signal Hs supplied from the external host CPU device is varied in accordance with the first pattern and the second pattern, thereby shortening one horizontal scanning period on the second pattern.

(2) In the aforementioned embodiment, the example in which the horizontal scanning periods corresponding to even-numbered scanning lines were set as the periods of performing the precharge thinning drive was described. However, the invention is not limited to such a configuration, and the precharge thinning drive may be performed in arbitrary periods.

(3) Although a liquid crystal was exemplified as an example of the electrooptical material in the aforementioned embodiments, the invention is applied to electrooptical devices that use other electrooptical materials. The electrooptical material is a material with optical properties such as transmittance and luminance that vary in response to supply of an electric signal (a current signal or a voltage signal). For example, the invention can be applied to a display panel that uses light emitting elements such as an organic ElectroLuminescent (EL), inorganic EL, and light emitting polymer in the same manner as in the aforementioned embodiments. Also, the invention can be applied to an electrophoretic display panel using a microcapsule that includes colored liquid and white particles dispersed in the liquid as an electrooptical material in the same manner as in the aforementioned embodiments. Furthermore, the invention can be applied to a twist ball display panel using a twist ball with different colors applied to regions with different polarities as an electrooptical material in the same manner as in the aforementioned embodiments. The invention can also be applied to various electrooptical devices such as a toner display panel using a black toner as an electrooptical material and a plasma display panel using high-pressure gas such as helium or neon as an electrooptical material in the same manner as in the aforementioned embodiments.

Application Examples

Figure 7:
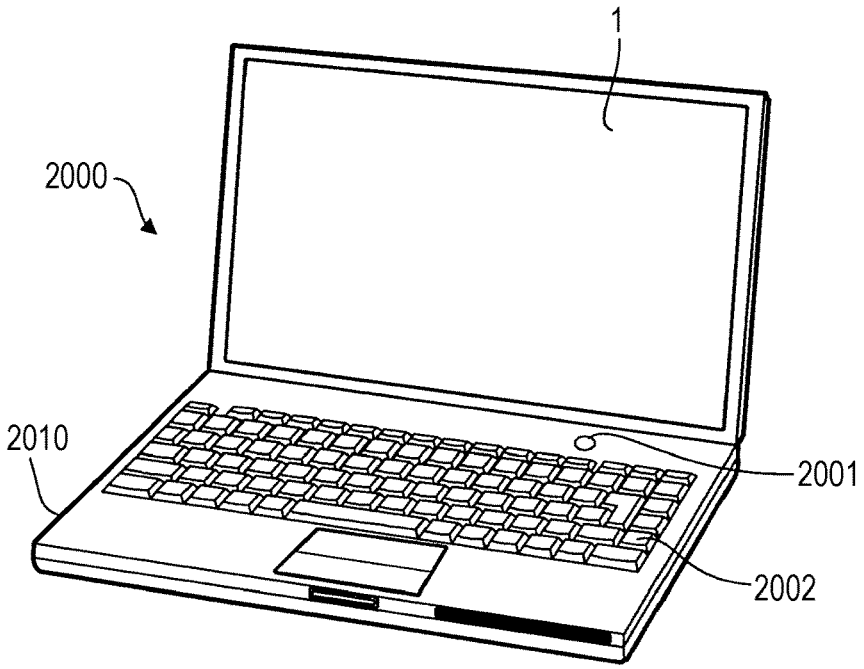
FIG. 7 is an explanatory diagram illustrating an example of an electronic device.
Figure 8:
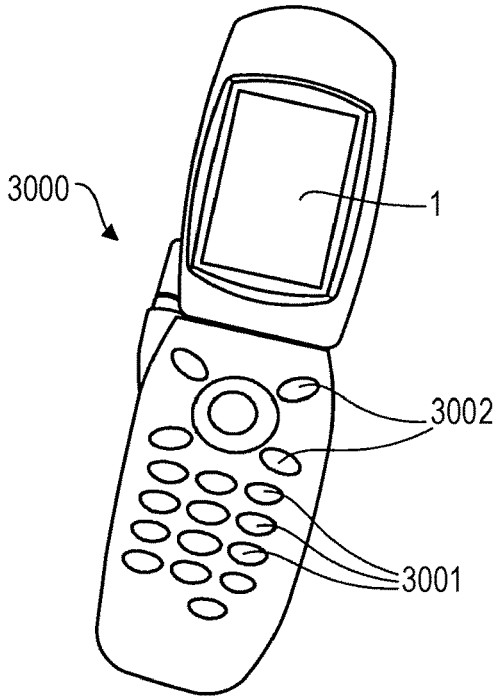
FIG. 8 is an explanatory diagram illustrating another example of the electronic device.
Figure 9:
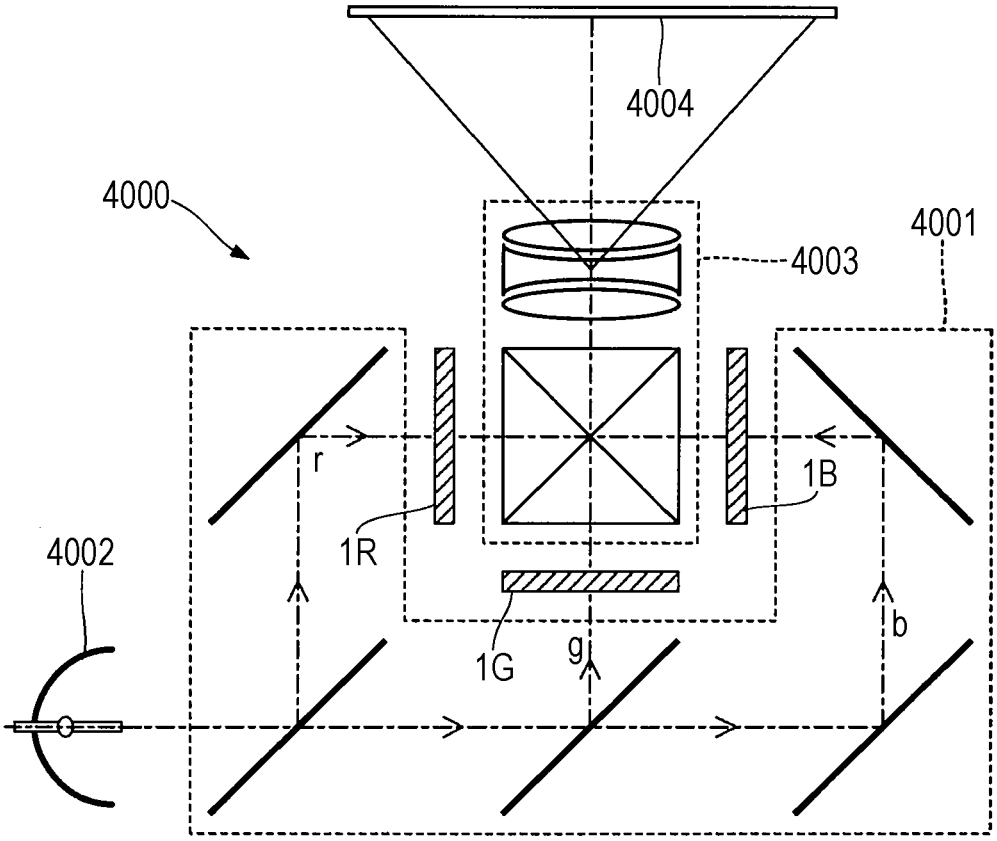
FIG. 9 is an explanatory diagram illustrating another example of the electronic device.

The invention can be utilized for various electronic devices. FIGS. 7 to 9 illustrate specific forms of the electronic devices as targets of applications of the invention.

FIG. 7 is a perspective view of a portable personal computer that employs the electrooptical device. A personal computer 2000 includes the electrooptical device 1 that displays various images and a main body 2010 with a power switch 2001 and a keyboard 2002 installed thereon.

FIG. 8 is a perspective view of a mobile phone. A mobile phone 3000 includes a plurality of operation buttons 3001, scroll buttons 3002, and the electrooptical device 1 that display various images. By operating the scroll buttons 3002, a screen displayed on the electrooptical device 1 is scrolled. The invention can also be applied to such a mobile phone.

FIG. 9 is a diagram schematically illustrating a configuration of a projection-type display apparatus (three-plate projector) 4000 that employs the electrooptical device. The projection-type display apparatus 4000 includes three electrooptical devices 1 (1R, 1G, and 1B) corresponding to different display colors R, G, and B, respectively. An illumination optical system 4001 supplies a red component r in light emitted from an illumination device (light source) 4002 to the electrooptical device 1R, supplies a green component g to the electrooptical device 1G, and supplies a blue component b to the electrooptical device 1B. The respective electrooptical devices 1 function as light modulators (light valves) that modulates the single color light supplied from the illumination optical system 4001 in accordance with a display image. A projection optical system 4003 synthesizes light emitted from the respective electrooptical devices 1 and projects the light to a projection surface 4004. The invention can also be applied to such a liquid crystal projector.

As electronic devices to which the invention is applied, a Personal Digital Assistant (PDA) is exemplified as well as the devices illustrated in FIGS. 1, 7, and 8. In addition, a digital still camera, a television, a video camera, a car navigation device, a display for a vehicle (instrument panel), an electronic databook, electronic paper, a calculator, a word processor, a work station, a video phone, and a POS terminal are exemplified. Furthermore, a printer, a scanner, a copy machine, a video player, and a device provided with a touch panel are exemplified.

The entire disclosure of Japanese Patent Application No. 2016-074973, filed Apr. 4, 2016 is expressly incorporated by reference herein.

What is claimed is:

1. An electrooptical device comprising:

a plurality of scanning lines;

a plurality of data lines;

pixels that are provided so as to correspond to intersections between the plurality of scanning lines and the plurality of data lines;

a scanning line drive unit that supplies a scanning signal to the scanning lines;

a data line drive unit that supplies a first voltage with a magnitude in accordance with a tone to be displayed to the pixels via the data lines in a first period and supplies a second voltage including a low-potential second voltage and a high-potential second voltage to the data lines in a second period before the first period; and a control unit that controls the data line drive unit such that a first pattern in which the low-potential second voltage and the high-potential second voltage are sequentially output in the second period in one horizontal scanning period and a second pattern in which only the high-potential second voltage is output in the second period in one horizontal scanning period are switched in accordance with a selected scanning line, wherein the control unit controls the data line drive unit such that a supply period of the high-potential second voltage in the second pattern is shorter than a supply period of the high-potential second voltage in the first pattern.

2. The electrooptical device according to claim 1, wherein the data line drive unit includes a voltage amplification unit and a D/A conversion unit.

3. The electrooptical device according to claim 1, wherein the first period includes a tone display period, the second period includes a fly-back period, and the second voltage includes a precharge voltage.

4. The electrooptical device according to claim 1, further comprising:

a data line selection unit that is provided between the data line drive unit and the data lines and selects the data lines in a time division manner.

5. A control method of an electrooptical device that includes a plurality of scanning lines, a plurality of data lines, and pixels that are provided so as to correspond to the respective intersections between the plurality of scanning lines and the plurality of data lines, the method comprising:

supplying a scanning signal to the scanning lines;

supplying a first voltage with a magnitude in accordance with a tone to be displayed to the pixels via the data lines in a first period;

supplying a second voltage including a low-potential second voltage and a high-potential second voltage to the data lines in a second period before the first period; and switching a first pattern in which the low-potential second voltage and the high-potential second voltage are sequentially output in the second period in one horizontal scanning period and a second pattern in which only the high-potential second voltage is output in the second period in one horizontal scanning period in accordance with a selected scanning line, wherein a supply period of the high-potential second voltage in the second pattern is shorter than a supply period of the high-potential second voltage in the first pattern.

6. The control method of an electrooptical device according to claim 5, wherein digital data that represents a tone is converted into the analog first voltage and is then supplied to the data lines in the first period, and digital data that represents the second voltage is converted into the analog second voltage and is then supplied to the data lines in the second period.

7. The control method of an electrooptical device according to claim 5, wherein the first period includes a tone display period, the second period includes a fly-back period, and the second voltage includes a precharge voltage.

8. An electronic device comprising:

the electrooptical device according to claim 1.

* * * * *